US005666881A

United States Patent [19]

Zanoli

[11] Patent Number: 5,666,881

[45] Date of Patent: Sep. 16, 1997

[54] MACHINE FOR MOUNTING FLEXIBLE PRINTING PLATES ON PLATE-HOLDER CYLINDERS OF FLEXOGRAPHIC PRINTING MACHINES AND FOR PRINTING PROOFS

[75] Inventor: Alberto Zanoli, Sala Bolognese, Italy

[73] Assignee: Bieffebi S.p.A., Di Granarolo Emilia, Italy

[21] Appl. No.: 439,345

[22] Filed: May 11, 1995

[30] Foreign Application Priority Data

Feb. 24, 1995 [EP] European Pat. Off. ..... 95830052

[51] Int. Cl.[6] ..... B41F 5/00

[52] U.S. Cl. ..... 101/477; 101/216; 101/DIG. 36; 33/621

[58] Field of Search ..... 101/216, 415.1, 101/477, DIG. 36; 33/614–618, 621

[56] References Cited

U.S. PATENT DOCUMENTS

| | | | |
|---|---|---|---|
| 4,520,389 | 5/1985 | Hornschuh | 101/DIG. 36 |
| 4,653,369 | 3/1987 | Dunsim | 83/411 R |
| 4,936,212 | 6/1990 | Moss | 101/216 |
| 5,317,971 | 6/1994 | Deye, Jr. et al. | 101/486 |
| 5,488,781 | 2/1996 | Van Der Horst | 33/617 |

FOREIGN PATENT DOCUMENTS

| | | | |
|---|---|---|---|
| 89015 | 9/1983 | European Pat. Off. . | |
| 2170063 | 9/1973 | France . | |
| 2305264 | 8/1973 | Germany | 101/DIG. 36 |
| 0049218 | 3/1986 | Japan | 101/486 |

*Primary Examiner*—Christopher A. Bennett
*Attorney, Agent, or Firm*—Guido Modiano; Albert Josif

[57] ABSTRACT

Machine for mounting flexible printing plates on plate-holder cylinders and for printing proofs with the cylinders thus prepared, the machine being frontally provided with a counterpressure drum and with a beam which are horizontally parallel and move with respect to each other between a mounting position and a printing position. The counterpressure drum can rotate and is covered with a sheet of paper having registration markings. The beam is provided with supports that rotatably support a plate-holder cylinder. The machine comprises: an optical device with a semitransparent mirror, adapted to align directly-viewed points of the plate-holder cylinder in mounting position with reflected points of the sheet of paper; at least two video cameras, positionable along a bar that lies parallel to the drum and the cylinder and directed towards the plate-holder cylinder, which is in the mounting position, along respective axes that intersect the optical device and are substantially at right angles to the axis of the plate-holder cylinder; and front monitors connected to the respective video cameras.

16 Claims, 8 Drawing Sheets

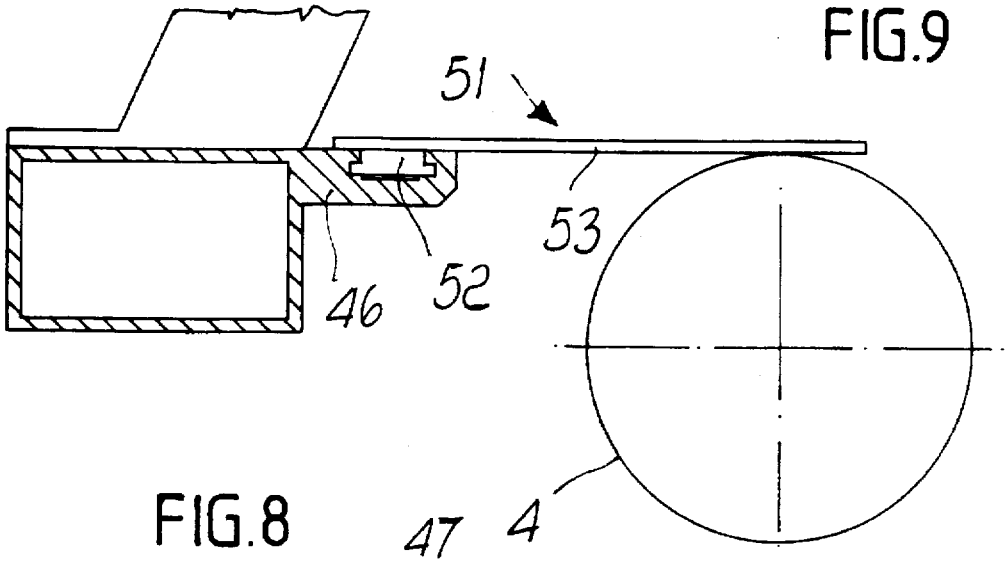
FIG.9
FIG.8
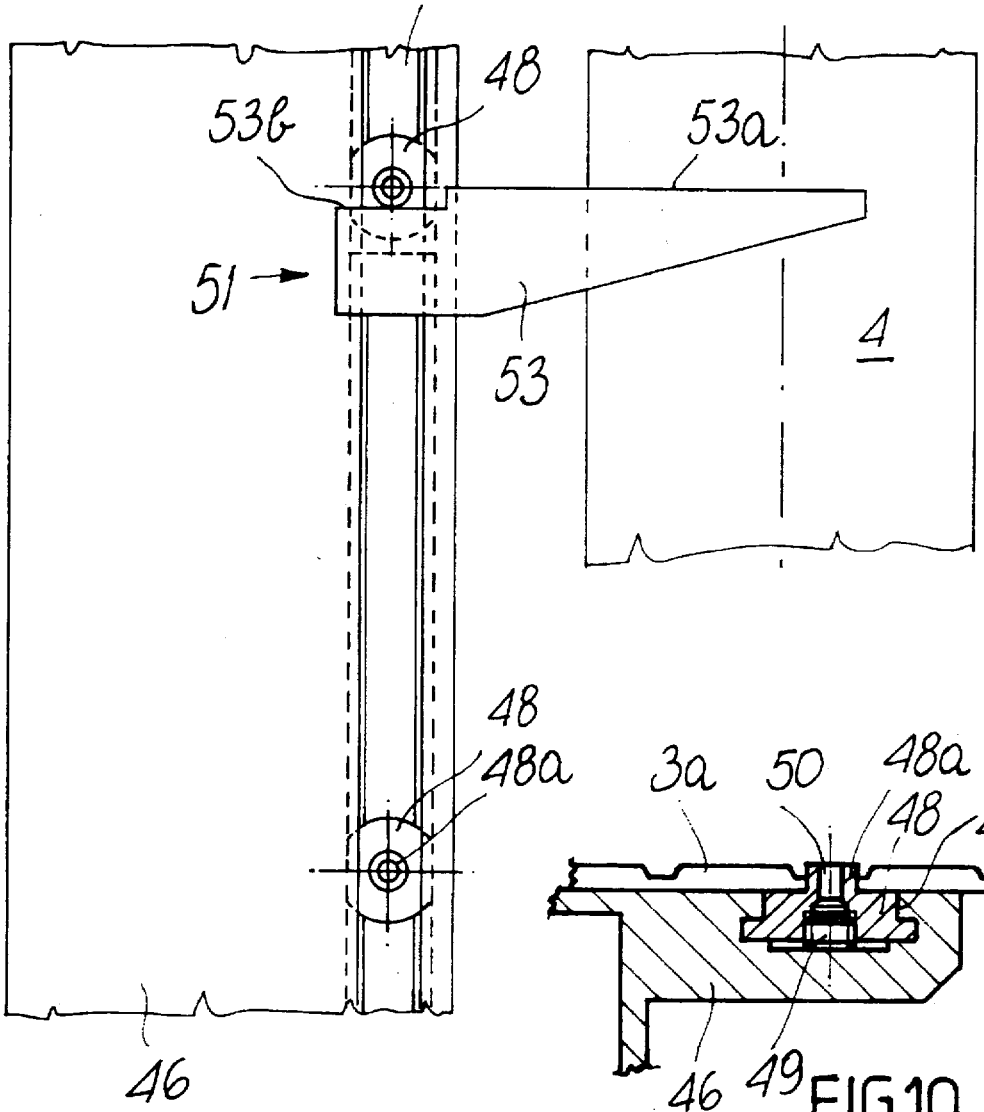
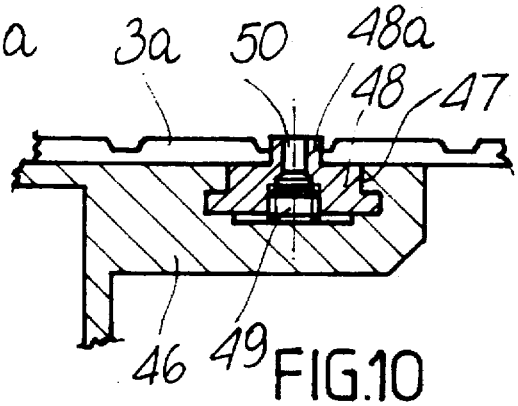
FIG.10

MACHINE FOR MOUNTING FLEXIBLE PRINTING PLATES ON PLATE-HOLDER CYLINDERS OF FLEXOGRAPHIC PRINTING MACHINES AND FOR PRINTING PROOFS

BACKGROUND OF THE INVENTION

The present invention relates to a machine for mounting (positioning and then fixing) flexible printing plates on plate-holder cylinders of flexographic printing machines and for printing proofs with the cylinders thus prepared.

Machines such as the one described in Italian patent no. 953251 in the name of the same Applicant are available for mounting printing plates and printing proofs and are generally known as combined optical proofing and plate mounting devices; hereinafter, for the sake of brevity, they will be referenced to as optical plate mounting devices.

Said known optical plate mounting devices are provided, in a front region, with a counterpressure drum that is installed horizontally and rotatably between the side walls of the machine and with a vertically sliding underlying beam provided with semicircular supports for supporting in succession a plate-holder cylinder so that it can rotate parallel to the drum.

The counterpressure drum is covered with a sheet of paper on which registration lines (or other markings) are applied: these registration lines run along straight generatrices and circular directrices of the drum and are usually marked by means of an appropriate writing stylus with which the plate mounting device is provided.

Double-adhesive sheet material is used to fix one or more printing plates on a plate-holder cylinder (or on a jacket wrapping around it) when said cylinder, supported by said beam, is in the so-called mounting position, which is at a certain distance from the counterpressure drum.

In order to precisely position the printing plates on a plate-holder cylinder, and therefore to fix the printing plates on said cylinder, the operator usually uses an appropriate optical apparatus provided with a semitransparent mirror; this apparatus is usually located frontally in current plate mounting devices, is arranged parallel to the counterpressure drum, has essentially the same length as the drum, and is movably mounted between an active position, which is lowered and intermediate between the counterpressure drum and a plate-holder cylinder in the mounting position, and a spaced position, which corresponds to proof printing.

By means of this apparatus, the operator aligns directly-viewed points of the printing plate located on the plate-holder cylinder, with reflected points of said sheet of paper wrapped around the counterpressure drum; the reflected points are generally related to registration lines, to markings, or to a proof provided on said sheet of paper.

The precision required in aligning the printing plates of the plate-holder cylinders and the markings on the counterpressure drum for quality multiple-color prints must not be lost when, after inking the printing plate, said beam and the cylinder to which the printing plate is fixed are raised, for proofing, into the corresponding position, in which the plate-holder cylinder comes into contact with the counterpressure drum; there is an appropriate kinematic linkage between the cylinder and the drum, which also acts as an intermediate element when it is necessary to turn said cylinder and said drum for said proofing so that they have the same peripheral speed.

When dealing with rubber printing plates and with their considerable deformability, the results obtainable with fixing performed by means of an optical apparatus are currently still satisfactory, despite the expenditure of time required.

Nevertheless, the difficulties involved in correcting observation and machine errors (with the need to adjust the angle of the semitransparent mirror and to correct parallax errors) and in handling large printing plates must be taken into account.

Optical plate mounting devices are less appreciated when dealing with inextensible printing plates (photopolymeric ones or rubber ones provided with an antistretch layer); their very feature of being substantially inextensible is not used fully, especially in terms of quickness in mounting.

Mounting becomes quicker if the inextensible printing plates have been precisely provided beforehand with registration holes and if the plate mounting device has been provided with an adapted bar or surface. Said bar or surface in practice occupies the entire width of the plate mounting device, as far as they are parallel to the counterpressure drum and their corresponding dimension is substantially equal to the length of the drum; they assume an active position and a spaced position and are provided with adjustable pins for engaging said holes of the printing plates. In known plate mounting devices, for example, the pin supporting bar is provided frontally and is fixed to the optical apparatus.

Rather expensive plate mounting devices have more recently become available only for inextensible printing plates provided with microdots or with register marks, said plate mounting devices being no longer provided with an optical apparatus equipped with a semitransparent mirror but with video cameras and respective monitors forming systems that greatly magnify the registration markings (for example 140 times).

The monitors are fixed, whereas the video cameras are positionable along a bar arranged in front of the plate mounting device and lying above the plate-holder cylinder. Before fixing the printing plates onto the plate-holder cylinders, said microdots or register marks, seen by the video cameras on the plate-holder cylinder, are aligned with electronically generated register marks shown on the monitors.

In some cases the position of the video cameras can be controlled by a computer; accordingly, the video camera can easily resume given positions only after demanding computer programming.

In other cases, the video cameras must be positioned manually, and this requires great accuracy; essentially, a given job requires a number of video camera pairs equal to the number of printing plates that must be fixed to each plate-holder cylinder during that print job; accordingly, the number of printing plates that can be fixed to a plate-holder cylinder is rather limited, since the number of pairs of video cameras that can be applied to a plate mounting device is limited.

SUMMARY OF THE INVENTION

The aim of the present invention is to provide a machine for mounting flexible printing plates on plate-holder cylinders of flexographic printing machines and for printing proofs with the cylinders thus prepared, said machine, in comparison with known plate mounting devices, allowing to run high-precision operations easily and quickly with printing plates of all kinds (deformable or inextensible ones, rubber or photopolymeric ones, with or without register marks, microdots, or holes) and of various sizes.

Another object of the machine according to the invention is to be simple in concept, reliable in operation, and economically advantageous in terms of costs and operation.

With this aim and this object in view, there is provided, according to the present invention, a machine for mounting flexible printing plates on plate-holder cylinders of flexographic printing machines and for printing proofs with the cylinders thus prepared, said machine being frontally provided with a counterpressure drum and with a beam which are horizontally parallel and move with respect to each other between a mounting position and a printing position, said counterpressure drum being rotatable and covered with a sheet of paper having registration markings, said beam being provided with supports that rotatably support a plate-holder cylinder, said machine being characterized in that it comprises: an optical device with a semitransparent mirror, adapted to align directly-viewed points of said plate-holder cylinder in mounting position with reflected points of said sheet of paper; at least two video cameras positionable along a bar that lies parallel to said drum and cylinder and directed towards the plate-holder cylinder, which is in the mounting position, along respective axes that intersect said optical device and are substantially at right angles to the axis of said plate-holder cylinder; and front monitors connected to said respective video cameras.

Advantageously, said video cameras and monitors form low-magnification systems; magnification can be between 2 and 10 times.

Conveniently, each one of said video cameras is mounted onto a respective slider of said bar, which also includes a small semitransparent mirror constituting said optical device related to said video camera.

BRIEF DESCRIPTION OF THE DRAWINGS

The features of the invention will become apparent from the following detailed description of a preferred embodiment of a machine for mounting flexible printing plates on plate-holder cylinders and for printing proofs with the cylinders thus prepared, illustrated only by way of non-limitative example in the accompanying drawings, wherein:

FIG. 8 is a plan view of a detail of FIG. 7;

FIG. 9 is a transverse sectional view of the same detail shown in FIG. 8;

FIG. 10 is an enlarged-scale transverse sectional view of a detail of FIG. 8;

DESCRIPTION OF THE PREFERRED EMBODIMENTS

Figure 1:
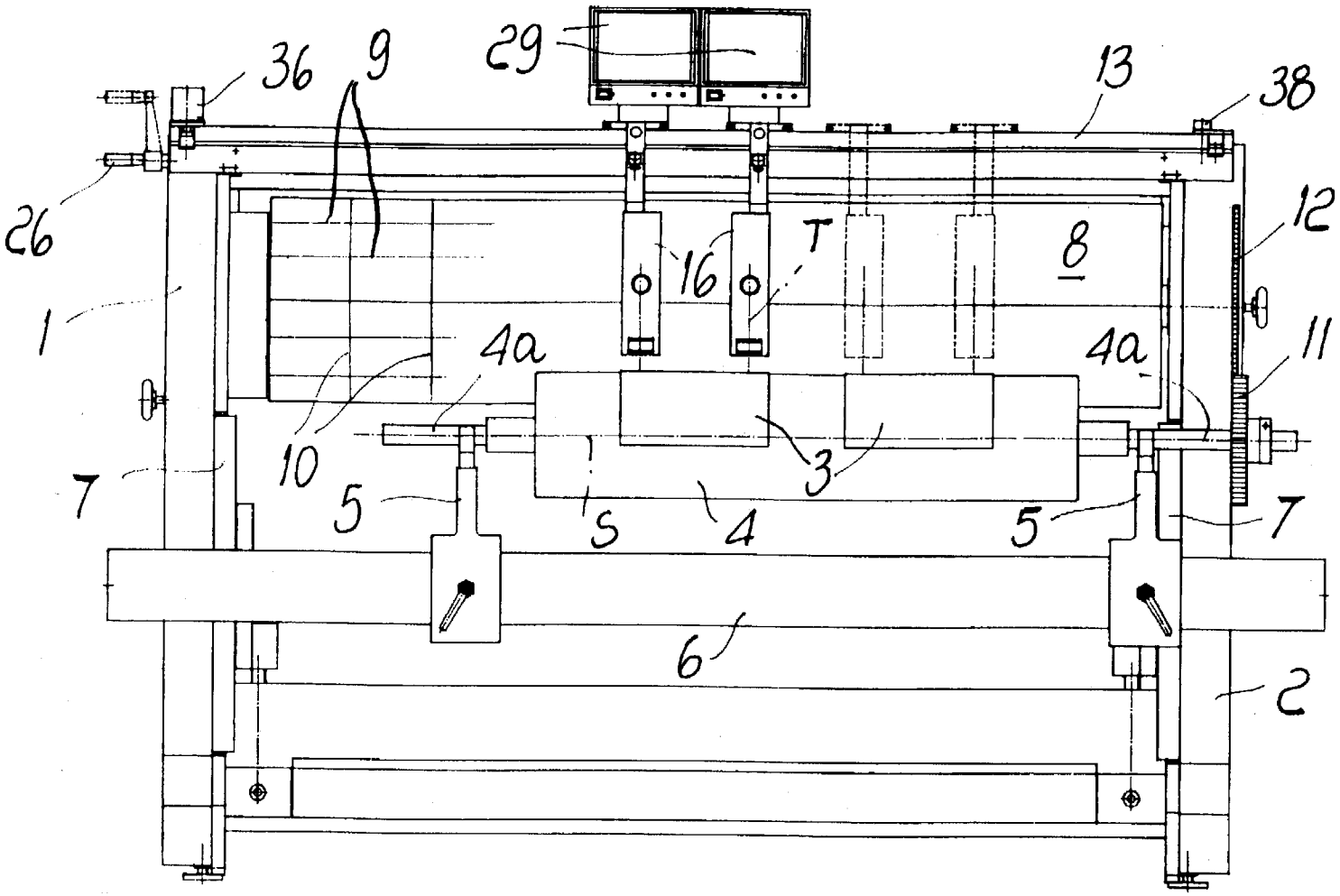
FIG. 1 is a front view of said machine.

With particular reference to the above figures, the reference numerals 1 and 2 designate the box-like sides of the machine for mounting flexible printing plates 3 on plate-holder cylinders 4 and for printing proofs with the cylinders thus prepared.

Figure 3:
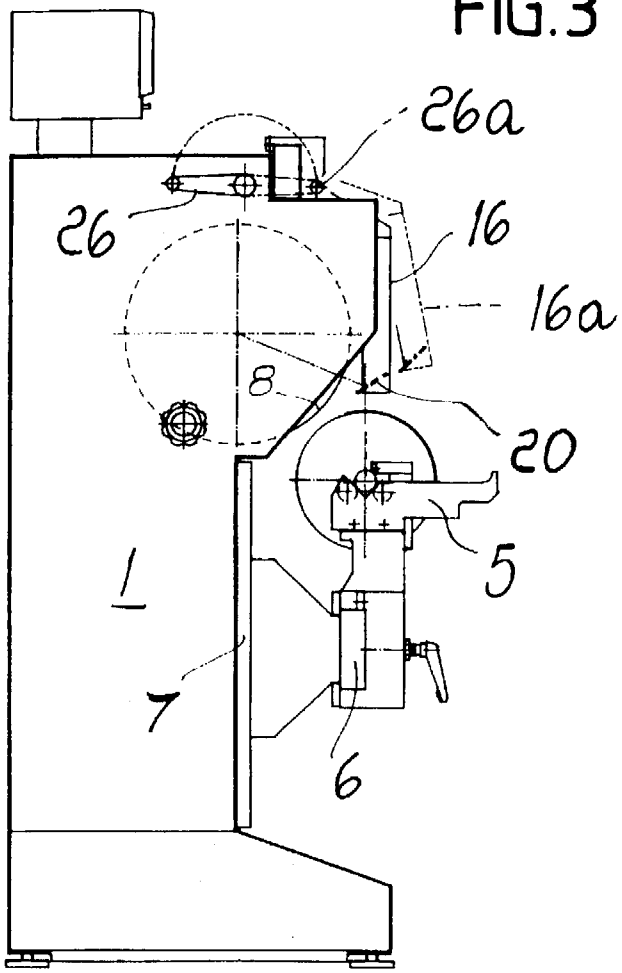
FIGS. 2 and 3 are respective side views of said machine, taken from opposite sides.
Figure 2:
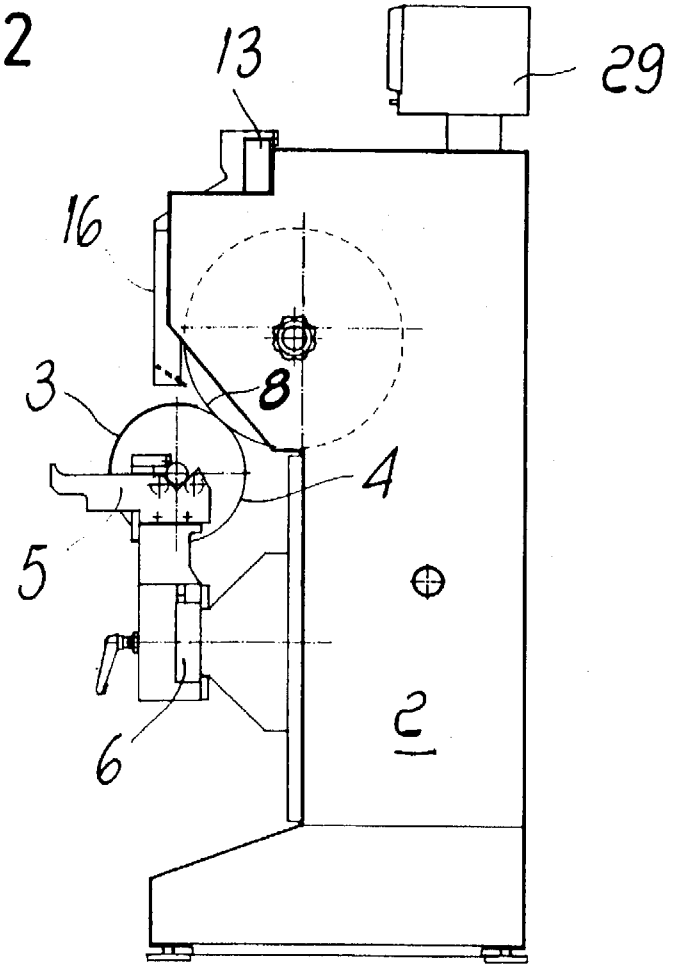
Figure 4:
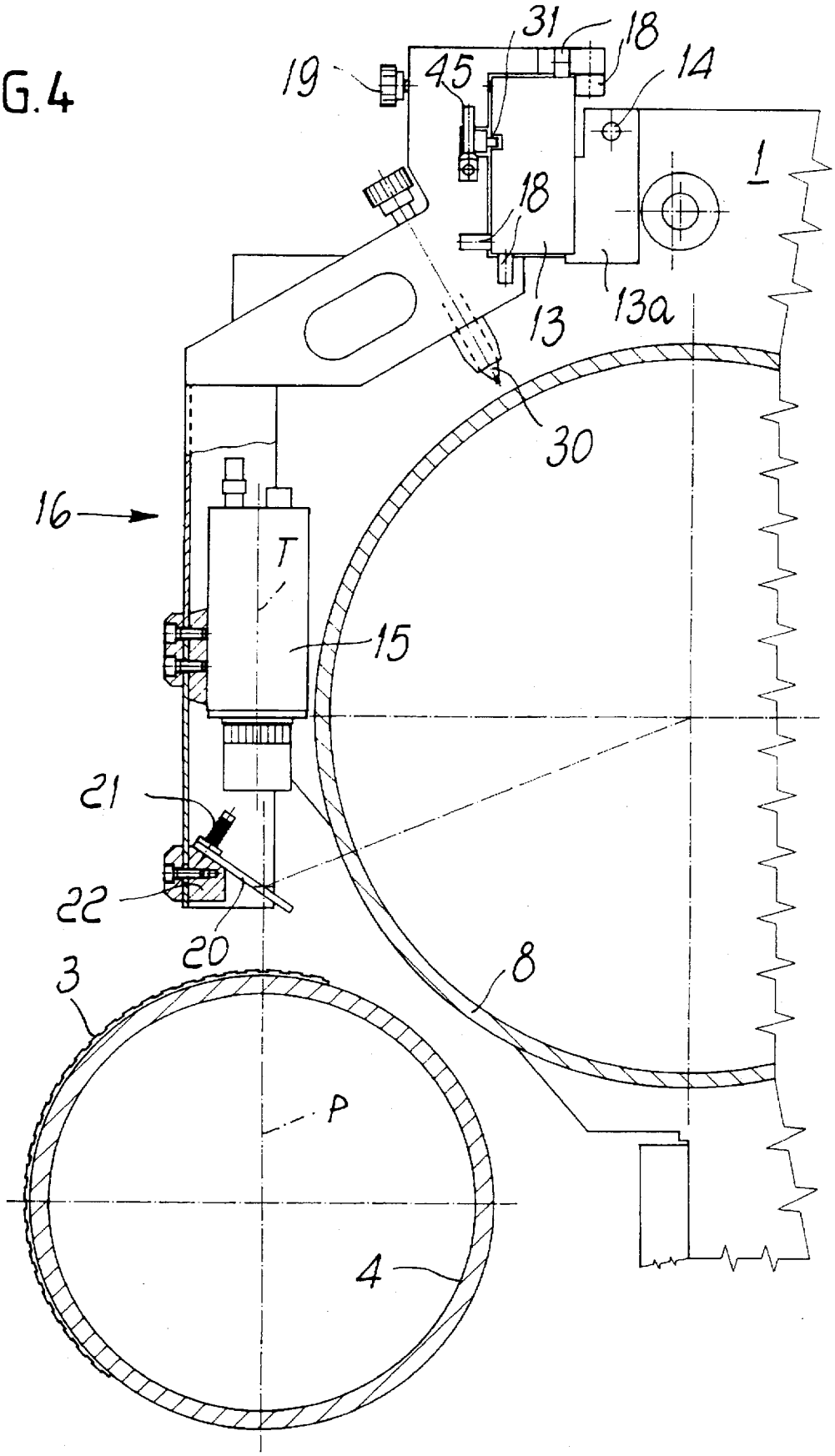
FIG. 4 is essentially a partial transverse sectional view of the machine, taken along a vertical plane that lies at right angles to the front of said machine.

A plate-holder cylinder 4, with its pivot-like axial ends 4*a*, is horizontally and rotatably supported by the semicircular supports 5, which are positionable along a beam 6. Said beam can move vertically along the guides 7, which lie in front of the sides 1 and 2, between a lowered mounting position (FIGS. 3 and 4) and a raised printing position (FIG. 2); in the mounting position, the printing plates are positioned and fixed onto the plate-holder cylinder, whereas in the printing position they come into contact with the overlying counterpressure drum 8.

The drum 8 is rotatably mounted between the sides 1 and 2 so that it lies parallel to the plate-holder cylinder mounted on the beam 6; said drum is covered with a sheet of paper provided with registration markings: registration lines 9 and 10 that run respectively along straight generatrices and circular directrices of said cylinder 8 are usually marked on said sheet.

In the mounting position, the uppermost generatrix of the printing plate, which wraps around the plate-holder cylinder mounted on the beam 6, is always at the same level and therefore in the same relative arrangement with respect to the counterpressure drum 8, regardless of the diameter of the plate-holder cylinder and of the thickness of the printing plate. The mounting position is determined by the semitransparent-mirror optical device, with which the machine is frontally provided, said device matching directly-viewed points of the plate-holder cylinder (or rather of a printing plate positioned thereon) in mounting position, with reflected points of the sheet of paper covering the counterpressure drum.

As in conventional machines, such as the one disclosed in Italian patent no. 953251 in the name of the same Applicant, the semitransparent mirror of said device can in practice be as long as the counterpressure drum 8, to which it is parallel, and can be movably mounted between an active position, which is lowered and lies between said counterpressure drum and a plate-holder cylinder in the mounting position, and a spaced position, which corresponds to proof printing. Of course, this solution, which uses a single long semitransparent mirror, does not need to be shown in the figures. In any case, differently from conventional machines, as will become apparent, in order to provide said desired match between printing plate points and paper sheet points by using the semitransparent mirror, the invention does not make use of the simple and direct sighting performed by the operator of the machine but uses the mediation of video cameras and monitors, thus eliminating awkwardness in sighting, differences among work steps performed by different operators, and sighting errors caused by sight defects and by the positions assumed by the operator's eye.

As in conventional machines, the counterpressure drum 8 is adapted to cooperate with the plate-holder cylinder 4, which is supported by the beam 6; the kinematic connection through which this cooperation between the cylinder 4 and the drum 8 occurs, comprises respective gears 11 and 12 and a constant-speed joint, which is not shown.

A bar 13 lies above the counterpressure drum so that it is parallel thereto and is located in front of the machine; the bar 13 is pivoted at 14, by means of its lugs 13*a*, to the sides 1 and 2 along an axis that is again parallel to the drum 8. At least two video cameras 15 are positionable along the bar 13. Each video camera is in fact applied to the central region of a respective box-like shaped contoured arm 16 which forms a slider 17 in an upward region; said slider is slideably mounted onto the bar 13 by means of a plurality of rollers 18 and can be locked thereon in the desired position by means of a screw 19 (of its own).

When the two video cameras 15 are in the active position (with the arm 16 in the position shown in FIGS. 2, 4, and 7), they are directed towards the plate-holder cylinder 4, placed in the mounting position, along respective vertical axes T; said axes intersect said semitransparent-mirror optical device, are substantially perpendicular to the axis S of said plate-holder cylinder, and in practice lie on the vertical plane P through which the axis S passes during the ascending and descending motions of the beam 6. Instead of having said single long semitransparent mirror, the optical device can have a small semitransparent mirror 20, as shown in the figures, on each arm 16 below the respective video camera. Springs 21 keep the semitransparent mirrors 20 pressed against supports 22 provided on said arms 16.

When the two video cameras 15 are in the active position, the bar 13 and its screws 23 rest by gravity against the sides 1 and 2. When the arms 16 and the video cameras are raised into the spaced position for proof printing, the roller 24 engages a lug 13*a* of the bar 13; said roller is supported by an eccentric portion of the pivot 25 which is rotatably mounted to the corresponding side 1. The lever 26 is keyed on the pivot 25; said lever is generally shown in solid lines and in the condition in which the bar 13 is in the active position, whereas in FIG. 3 it is also shown in dashed lines and in the condition 26*a* in which, since the roller 24 has engaged the lug 13*a*, the arms 16 are in the spaced position 16*a*, also shown in dashed lines, and the protrusion 27, which lies radially to the pivot 25 (FIG. 6), rests onto the abutment 28 rigidly coupled to the side 1.

The video cameras 15 are connected to respective monitors 29 arranged on a beam that joins the top of the sides 1 and 2. The video cameras and the monitors form low-magnification systems. Magnification can be comprised between 2 and 10 times; a magnification of approximately 4 is preferred.

A respective writing stylus 30 is mounted on at least one arm 16, directly below the slider 17, and is adapted to mark, in a known manner, the registration lines 9 or 10 when the stylus is actuated and the slider slides along the bar 13 or, respectively, the cylinder 8 turns.

The sliders 17 (and therefore the arms 16 and the video cameras 15) are connectable, in a mutually exclusive manner, to a belt 31 which is closed in a loop and wraps around the pulleys 32 and 33, which are rotatably mounted at the ends of the bar 13. In order to control the movements of the belt 31 (and therefore of the video camera optionally connected thereto) along the bar 13, said belt or said bar can be appropriately graduated.

Otherwise, the pulley 32 has angularly distributed pins 34 engaging holes 35 which are uniformly distributed along the belt 31; said pulley is furthermore keyed to the shaft of an encoder 36 connected to a display, not shown.

The pulley 33 furthermore forms, in an upper region, a set of teeth with which a sprocket 37 meshes; said sprocket can be actuated by means of the knob 38 to make the belt (and therefore the video camera connected thereto) perform limited movements; for large movements it is sufficient to manually drag the video camera (and therefore the belt to which it is optionally connected).

In any case, it should be noted that in view of the selected degree of magnification and of the consequent extent of the surface that can be inspected with the individual video camera, video camera positioning does not require particular accuracy and can therefore be performed very quickly.

Respective blocks 39 and 40 are fixed to the ends of the belt 31 in order to close it in a loop and tension it; screws 41, driven into the block 40, pass through the block 39; respective springs 42 are arranged around said screws, between the head of the screws 41 and the block 39, and push said block against the block 40.

Figure 5:
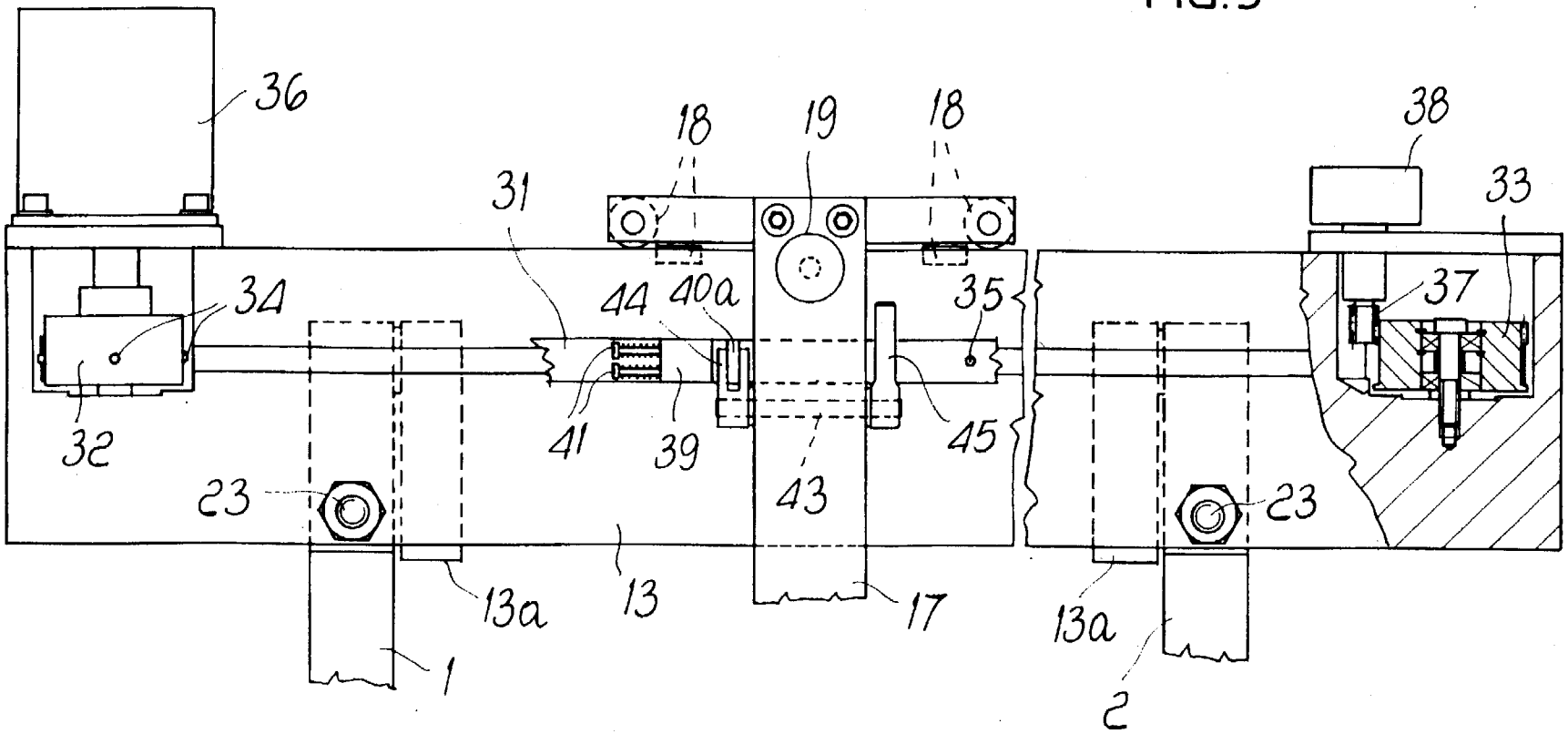
FIG. 5 is a detail of the front view.
Figure 6:
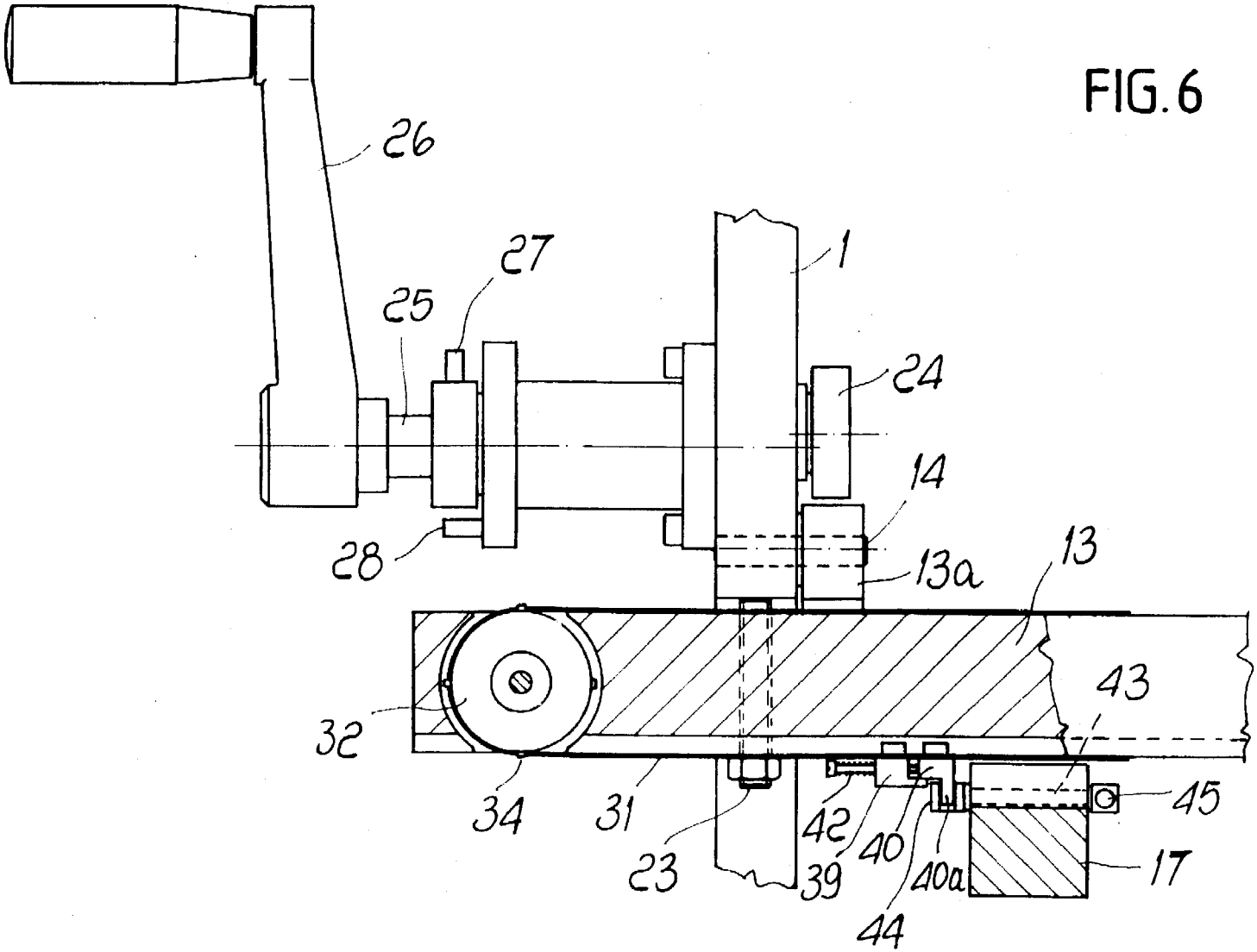
FIG. 6 is essentially a partial horizontal sectional view of the detail of FIG. 5.

In order to connect it to the belt 31, each slider 17 has a fork 44 pivoted thereto by means of a pivot 43; in the active condition, shown in FIGS. 5 and 6, said fork is directed upwards, wraps around the protrusion 40*a* of the block 40, and is fitted thereon. The pivot 43, passing through the slider, is provided with the rigidly coupled fork 44 at one end and with an actuation lever 45 at the other end; by acting on said lever 45, the fork assumes the inactive downward-facing condition and, vice versa, the active one.

With reference to FIGS. 7 to 13, the machine for fixing flexible printing plates on plate-holder cylinders and for then printing proofs can also be equipped with a bar 46 that lies in front of the counterpressure drum 8, is parallel thereto, and has a longitudinal slot 47 preferably shaped like an inverted T in cross-section.

Elements 48 can be arranged along the slot 47 (FIGS. 7 to 10); said elements essentially have a cross-section that is complementary to the cross-section of the slot, and protrude thereabove with a sort of respective pin 48*a*. The pins 48*a* engage registration holes of inextensible printing plates 3*a* provided with holes. In order to lock each element 48 in the desired position along the slot 47, a grub screw 49 is screwed into each element and acts on the bottom of said slot; said grub screw can be activated by reaching it through a hole 50 that is coaxial to the pin 48*a* and is open upwards.

L-shaped elements 51 can be used to position (and then lock) the elements 48 along the slot 47. Each one of said L-shaped elements in fact has a lower portion 52, which can be coupled to the slot with a side-fitting engagement, and has a laminar upper part 53, protruding, when the bar 46 is in the active position, as shown in the figures, towards the plate-holder cylinder 4 until it covers it beyond its uppermost generatrix. The part 53 has a longitudinal edge divided into two portions 53*a* and 53*b* which are mutually offset by an extent that is equal to the radius of a pin 48*a*. The portion 53*a* is suitable to be located on vertical planes that lie transversely to the plate-holder cylinder 4 and to be moved so that it is aligned, by means of said semitransparent mirrors, video cameras and monitors, with lines 10 applied on said paper sheet. When the portion 53*a* accordingly matches a desired line 10, the pin 48*a* of an element 48 is arranged adjacent to the portion 53*b*; said pin also matches the desired line 10.

The ends of the bar 46 are supported by respective arms 54 which are oscillatably mounted on the respective sides 1 and 2 about an axis 55. Accordingly, the bar can stably assume said lowered active position proximate to a plate-holder cylinder placed in the mounting position, or a removed and raised position in which it is possible to print proofs: in this latter position, the arms 54 are in the condition shown partially in dashed lines in FIG. 7 and designated by the reference numeral 54*a*.

Figure 7:
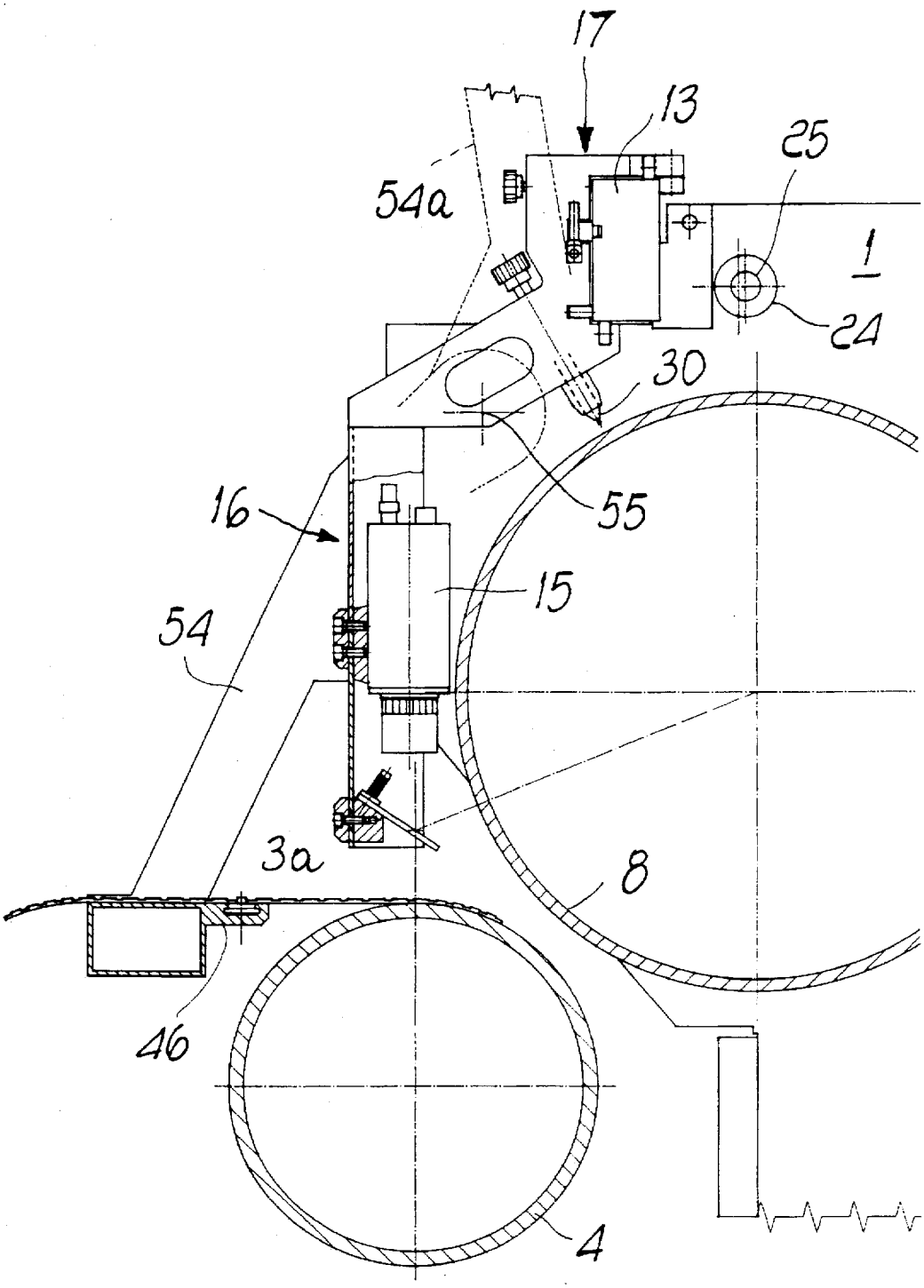
FIG. 7 is a view, similar to FIG. 4, of a more extensively equipped machine.
Figure 12:
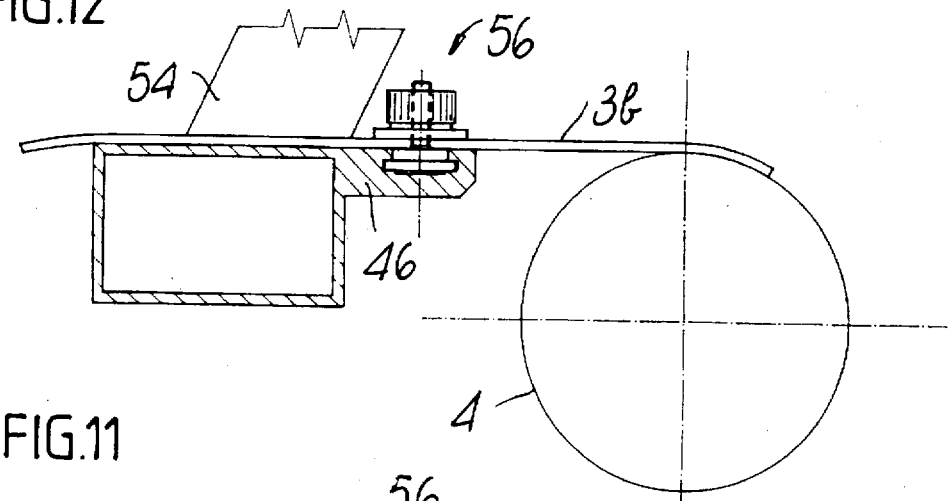
FIGS. 11, 12, and 13 are views, similar to FIGS. 8, 9, and 10 respectively, of said detail of FIG. 7 used differently.
Figure 11:
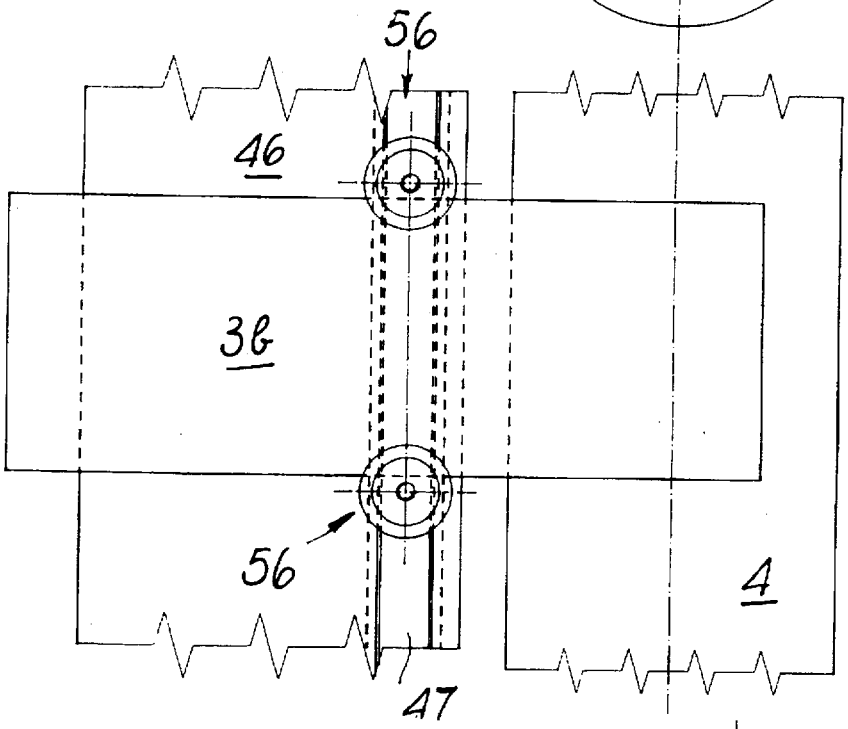
Figure 13:
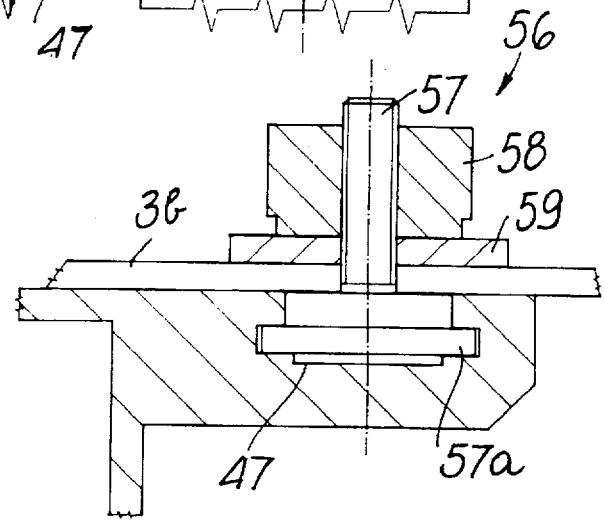

After the elements 48 have been positioned and locked along the bar 46 as mentioned, and after the perforated printing plate has engaged the pins 48*a* and has been placed onto the plate-holder cylinder 4 as shown in FIG. 7, said printing plate is partially fixed to said cylinder; fixing is then completed, after disengaging the printing plate from the pins and removing the bar 46, and checked by using the semitransparent mirrors, the video cameras and the monitors. In order to fix the printing plate, the non-stick protective film is removed from the outer surface of the material made of double-adhesive sheet applied to the plate-holder cylinder.

Once a first printing plate related to one color has been fixed, and once the proof has been printed with said first printing plate, the video cameras and the monitors can be used to check the fixing of the printing plates related to the other colors to the respective plate-holder cylinders, by referring to the printing of the first color and without the need, especially in the case of inextensible printing plates, to complete the proof with the remaining colors.

Obviously, in its active position the bar 46 is particularly advantageous as a service surface for the printing plates to be fixed, even if said printing plates are not perforated and especially if they are large.

In this case, one flap of the printing plate 3*b* (FIGS. 11 to 13) is placed onto the plate-holder cylinder 4, positioned in the mounting position, and since said protective film of the double-adhesive sheet has not yet been removed, the flap is correctly positioned on said cylinder by means of the video cameras and monitors. A pair of a sort of lateral clamps 56 is used to lock the printing plate 3*b* in the correct position and to the bar 46; once said non-stick film has been removed, said flap of the printing plate is fixed to the cylinder 4; the fixing of the printing plate is finally completed after releasing the clamps. Each clamp 56 is constituted by a screw 57 the head 57*a* whereof is substantially shaped complementarily, in cross-section, with respect to the slot 47; the stem of the screw protrudes above said slot, and the externally knurled nut 58 is coupled thereto; the washer 59 is interposed between the nut and the printing plate.

It should particularly be stressed that the system composed of semitransparent mirrors, video cameras, and monitors, as devised above, no longer requires to adjust the angle of the semitransparent mirrors and avoids parallax errors.

In the practical embodiment of the invention, the materials employed, as well as the shapes and dimensions, may be any according to the requirements.

What is claimed is:

1. A machine for mounting flexible printing plates on plate-holder cylinders of flexographic printing machines and for printing proofs with the cylinders thus prepared, said machine comprising:

a beam located at front region of the machine;

supports being positionable along said beam;

a plate-holder cylinder extending horizontally along a longitudinal axis thereof and being rotatably supported on said supports;

a counterpressure drum being rotatably supported at said front region of said machine, parallely to said plate-holder cylinder;

a sheet of paper having registration markings and covering said counterpressure drum, said beam and counterpressure drum being horizontally parallel and movable with respect to each other between a mounting position, for mounting flexible printing plates on said plate-holder cylinder, and a printing position;

a semitransparent mirror optical device provided at said front region of the machine for aligning directly-viewed points of said plate-holder cylinder in mounting position with reflected points of said sheet of paper;

a bar lying parallel to said counterpressure drum and said plate-holder cylinder;

at least two video cameras being positionable along said bar, said cameras being directed towards the plate-holder cylinder, in the plate mounting position, along respective axes that intersect said optical device and are substantially at right angles to an axis of said plate-holder cylinder; and front monitors connected to said respective video cameras.

2. Machine according to claim 1, wherein said video cameras and monitors form low-magnification systems.

3. Machine according to claim 2, wherein magnification of said low-magnification systems is comprised in a range of 2 to 10 times, with a magnification value of 4 times being preferred.

4. Machine according to claim 1, comprising sliders which are slideable and respectively lockable along said bar, each one of said video cameras being mounted onto a respective one of said sliders; and small semitransparent mirrors constituting said optical device, each of said mirrors being related to each one of said video cameras.

5. Machine according to claim 3, further comprising a writing stylus mountable on at least one of said sliders for tracing registration lines on said paper sheet that covers said counterpressure drum.

6. Machine according to claim 4, comprising a belt to which said sliders are connectable, said belt being runningly mounted between ends of said bar; and controlling means for controlling movement extent of said belt.

7. Machine according to claim 1, wherein said semitransparent-mirror optical device lies parallel to said counterpressure drum and is oscillatably mounted between an active position, in which the optical device is respectively lowered and lies between the counterpressure drum and a plate-holder cylinder in the mounting position and a spaced position in which the optical device is raised for proofs.

8. A machine for mounting flexible printing plates on plate-holder cylinders of flexographic printing machines and for printing proofs with the cylinders thus prepared, said machine comprising:

a beam located at front region of the machine;

supports being positionable along said beam;

a plate-holder cylinder extending horizontally along a longitudinal axis thereof and being rotatably supported on said supports;

a counterpressure drum being rotatably supported at said front region of said machine, parallely to said plate-holder cylinder;

a sheet of paper having registration markings and covering said counterpressure drum, said beam and counterpressure drum being horizontally parallel, with said beam being vertically movable between a lower mounting position, for positioning and fixing printing plates, and a raised printing position, in which the printing plates make contact with the counterpressure drum;

a bar lying parallel to and above said counterpressure drum;

at least two sliders that are slideable and respectively lockable upwardly along said bar;

respective small semitransparent mirrors, each of which is provided in a downward region of said sliders for allowing to align directly-viewed points of said plate-holder cylinder, in the mounting position, with reflected points of said paper sheet, video cameras being located each at a central region of a respective one of said sliders and directed towards the plate-holder cylinder, said cameras being placed in the mounting position, along axes that intersect said respective small semitransparent mirror and lying substantially at right angles to said axis of said plate-holder cylinder;

front monitors being respectively connected to a corresponding one of said video cameras to form low-magnification systems;

said bar being movable for oscillating between an active position in which said small semitransparent mirrors are lowered and arranged between the counterpressure drum and the plate-holder cylinder in the mounting position, and a proof printing position in which the semitransparent mirrors are raised in a spaced position.

9. Machine according to claim 8, further comprising writing styluses provided on said sliders for tracing registration lines on said paper sheet covering said counterpressure drum.

10. Machine according to claim 8, comprising a belt to which said sliders are connectable, said belt being runningly mounted between ends of said bar; and controlling means for controlling movement extent of said belt.

11. Machine according to claim 10, wherein said movement extent controlling means comprises graduations provided on any of said bar and said belt.

12. Machine according to claim 10, comprising pulleys being rotatably mounted at said ends of said bar, said belt being closed in a loop and wrapping around said pulleys, and said movement extent controlling means comprising an encoder connected to a first one of said pulleys and holes uniformly distributed along said belt, said first pulley being provided with angularly distributed pins for engaging said holes.

13. Machine according to claim 12, wherein a second one of said pulleys is actuatable for imparting limited movements to said belt and said sliders to which said video cameras are connected.

14. Machine according to claim 8, furthermore comprising a slotted bar that lies frontally and parallel to the counterpressure drum, said bar having a longitudinal slot; pin elements for engaging registration holes of printing plates; and L-shaped elements arrangeable adjacent to said pin elements, both said pin and L-shaped elements being positionable in said slot with the L-shaped elements aligneable, through said semitransparent mirrors, video cameras, and monitors, with registration markings applied on said paper sheet along directrices of the counterpressure drum, said slotted bar being oscillatably mounted between an active position and a spaced position, in which it is respectively lowered and proximate to a plate-holder cylinder in the mounting position and raised for proofs.

15. Machine according to claim 14, comprising clamp-like elements for locking printing plates laterally to said bar, said clamp-like elements being placed in said slot.

16. Machine according to claim 8, wherein magnification of said low-magnification systems is comprised in a range of 2 to 10 times, with a magnification value of 4 times being preferred.

* * * * *